US008647007B2

(12) United States Patent
Kuo

(10) Patent No.: US 8,647,007 B2
(45) Date of Patent: Feb. 11, 2014

(54) PUMP TOOTHBRUSH WITH INTEGRATED DENTIFRICE DISPENSING PLATFORM AND DISPOSABLE BRISTLE HEAD

(76) Inventor: Youti Kuo, Penfield, NY (US)

( * ) Notice: Subject to any disclaimer, the term of this patent is extended or adjusted under 35 U.S.C. 154(b) by 97 days.

(21) Appl. No.: 13/345,689

(22) Filed: Jan. 7, 2012

(65) Prior Publication Data

US 2012/0183343 A1 Jul. 19, 2012

Related U.S. Application Data

(60) Provisional application No. 61/461,075, filed on Jan. 13, 2011.

(51) Int. Cl.
*A46B 11/00* (2006.01)

(52) U.S. Cl.
USPC ..... 401/290; 401/286; 401/188 R

(58) Field of Classification Search
USPC ..... 401/188 R, 270, 276, 282, 286, 290
See application file for complete search history.

(56) References Cited

U.S. PATENT DOCUMENTS

| | | | | |
|---|---|---|---|---|
| 5,062,728 | A * | 11/1991 | Kuo | 401/176 |
| 5,158,383 | A * | 10/1992 | Glover et al. | 401/150 |
| 5,366,310 | A * | 11/1994 | Armelles Flors | 401/132 |
| 6,179,503 | B1 * | 1/2001 | Taghavi-Khanghah | 401/184 |
| 6,599,048 | B2 | 7/2003 | Kuo | |
| 7,789,583 | B2 | 9/2010 | Kuo | |

* cited by examiner

*Primary Examiner* — David Walczak

(57) ABSTRACT

Pump toothbrush comprising a pump head, a refillable cartridge containing dentifrice material, an integrated dispensing platform and a disposable bristle head. The pump head includes an inlet connector for attaching the cartridge, a pumping chamber attached with an elastic compressible button, and a dispensing platform. The dispensing platform contains a flow channel and a self-sealing slit-spout to prevent drying of the dentifrice material at the spout. The slit spout opens and closes automatically when the compressible button is pressed and released. The bristle head, which is the disposable part of the pump toothbrush, is attached to the dispensing platform for structural support and receiving the dentifrice material from the slit spout. Gum-guard elements are optionally attached to the periphery of the dispensing platform for massaging gums.

6 Claims, 7 Drawing Sheets

PUMP TOOTHBRUSH WITH INTEGRATED DENTIFRICE DISPENSING PLATFORM AND DISPOSABLE BRISTLE HEAD

Claiming priority benefit of Provisional Application No. 61/461,075, Filing Date: Jan. 13, 2011

BACKGROUND OF THE INVENTION

It has been recognized that toothbrush should be replaced on a regular basis since brushhead harbor germs after a period of use. While the entire toothbrush can be replaced, it is more economical to replace only the bristle head and retain the neck and the handle portions of the toothbrush to reduce waste of material. To maximize the value of the permanent neck and handle portions, it is desirable to utilize these permanent portions to store and dispense dentifrice material to the bristle head. For the ease of operation by handicapped persons, it is desirable to use a pushbutton to dispense dentifrice material. It is also desirable to attach gum-guard elements to the permanent neck portion for massaging gums.

1. Field of the Invention

This invention relates to a pump toothbrush having an integrated dispensing platform for repeated uses and a replaceable bristle-head part for minimal disposal.

2. Description of Related Art

U.S. Pat. No. 7,789,583 by Kuo describes a pump toothbrush including a pump head having an outlet connector, a brushhead attached to the outlet connector, and a cartridge containing dentifrice material. The detachable brushhead has a platform having bristles and a built-in flow channel attached with a slit spout. The flow channel is connected with the flow channel of the outlet connector of the pump head when the brushhead is mounted on the outlet connector to dispense dentifrice material through the slit spout to the bristles. The built-in slit spout in the brushhead presents manufacturability problem in the implanting of bristles around the spout due to tight space between the spout and the bristles. Also, the fact that the bristles and the base being of plastic material, which is recyclable, and the slit spout being of rubber material, which is non-recyclable, makes the whole brushhead a non-recyclable item. Furthermore, the neck portion adds significant amount of material to be thrown away with the brushhead.

For massaging and protecting gums U.S. Pat. No. 6,599,048 by Kuo describes a toothbrush utilizing a replaceable brush head having rubber gum guards on the peripheral edges of its bristle platform. The rubber gum guards are shorter than the height of the outer bristles to function as sensors for providing feedback to prevent brushing at excessive pressures and improper angles as well as for massaging the gumlines without the risk of gum damages. However the molded-in rubber gum guards add to the cost of the brush head. Therefore, it is desirable to have a pump toothbrush using a replaceable bristle head with a design configuration to enable manufacturability and minimal space required for the slit spout for dispensing the dentifrice material. It is desirable to have a pump toothbrush to minimize the amount of material for disposal. It is also desirable to keep the rubber gum-guard elements as part of the pump head for long term use, not disposed with the bristle head.

3. Objects of the Invention

An object of the present invention is to provide a pump toothbrush having a permanent dispensing platform to dispense dentifrice material to a replaceable bristle head for minimal disposal. It is another objective to attach gum guard elements to the periphery of the dispensing platform surrounding the disposable bristle head for massaging gum lines.

SUMMARY OF THE INVENTION

A pump toothbrush is provided with a pump head having an extended dispensing platform attached with a slit spout, a replaceable bristle head and a refillable cartridge for storing dentifrice material. The bristle head consists of only bristles and support base for minimal disposal. All the pump head, the dispensing platform, the slit spout and the cartridge are for repeated permanent uses. Besides having a through opening for the insertion of the slit spout, the base of the bristle head has its frontside attached with bristles and its backside attached with a pushbutton. The pushbutton is for inserting through a locating slot in the dispensing platform for mounting with lateral supports. The bristle head can be detached by pushing the snap-on button off the dispensing platform.

The pump head uses a resilient elastic compressible button to apply a pumping force to the dentifrice material to force it flow from the pumping chamber through the flow channel in the dispensing platform to the slit spout onto the bristle head. The slit spout is self-sealing to prevent drying of the dentifrice material at the spout opening. The slit spout is forced to open by the exiting dentifrice material and to close by the vacuum force created when the elastic button is released from the depressed position. The vacuum force also causes the piston in the cartridge advance to push the dentifrice material into the pump chamber through a one-way check valve in the pump head. The cartridge can be refilled by injecting the dentifrice material from its top opening to push the piston toward the bottom end of the cartridge. A fully refilled cartridge is reattached to the pump head for pumping. In one embodiment, gum guard elements are attached to the periphery of the dispensing outlet opening for massaging gums.

DETAILED DESCRIPTIONS OF THE PREFERRED EMBODIMENT

Figure 1A:
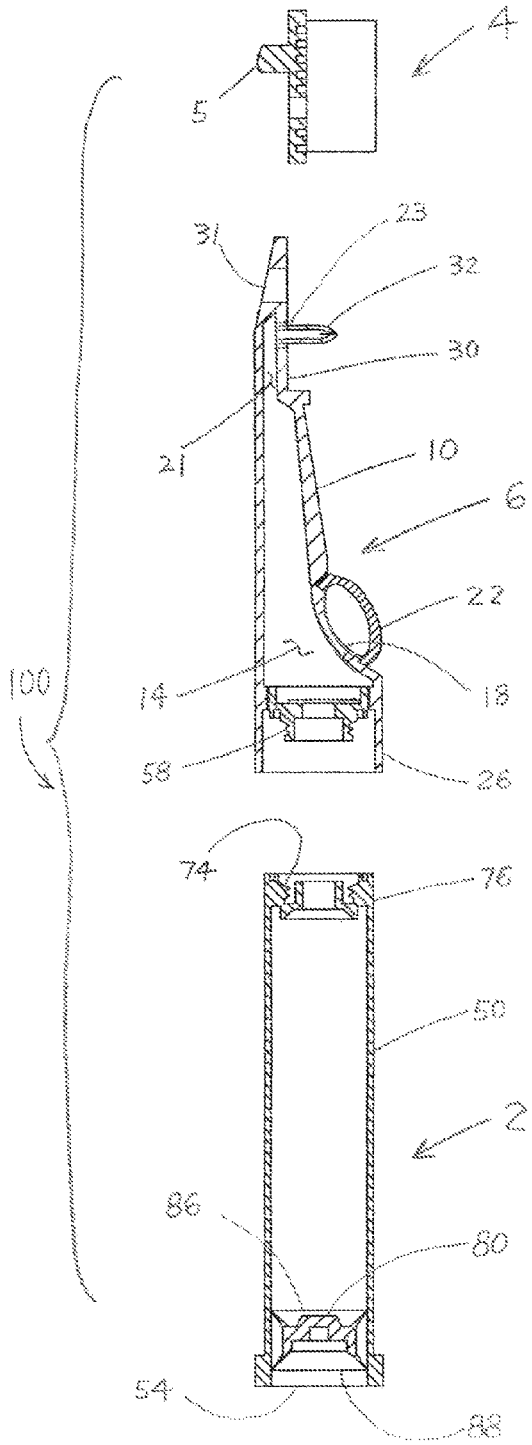
FIG. 1*a* is a front section view of an unassembled pump toothbrush having a pump head, a cartridge and a bristle head.

Throughout the following detailed description, same reference numerals refer to the same elements in all figures.

Pumping Chamber

Figure 1B:
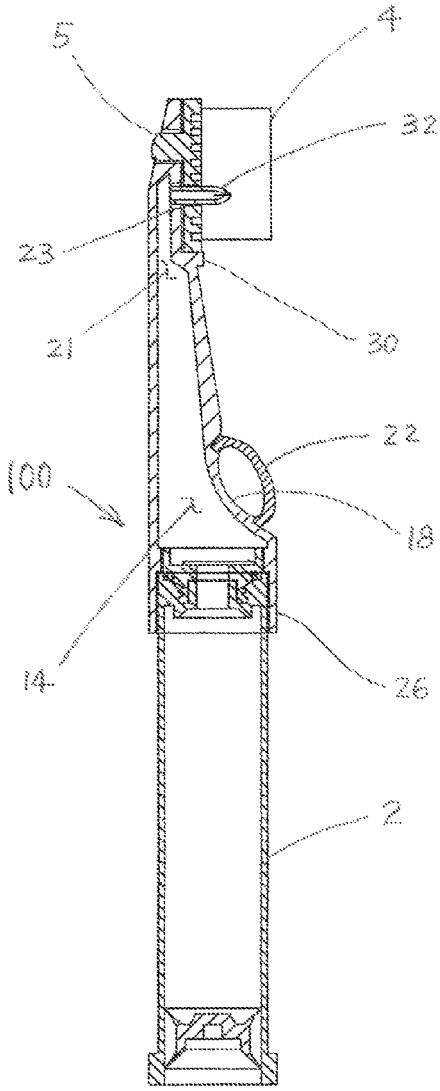
FIG. 1*b* is a front section view of an assembled pump toothbrush of FIG. 1*a*.
Figure 2A:
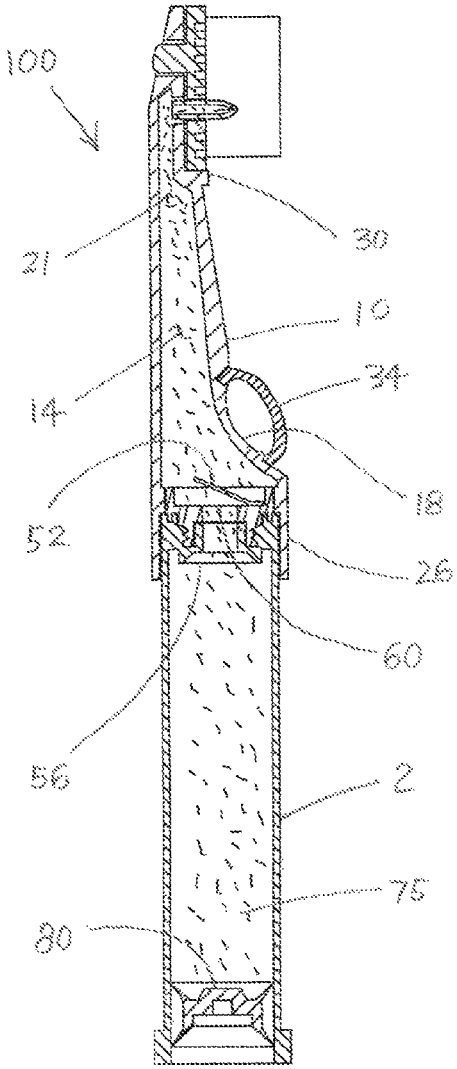
FIG. 2*a* is a front section view of a pump toothbrush with the check valve at opened position with the slit spout closed.
Figure 2B:
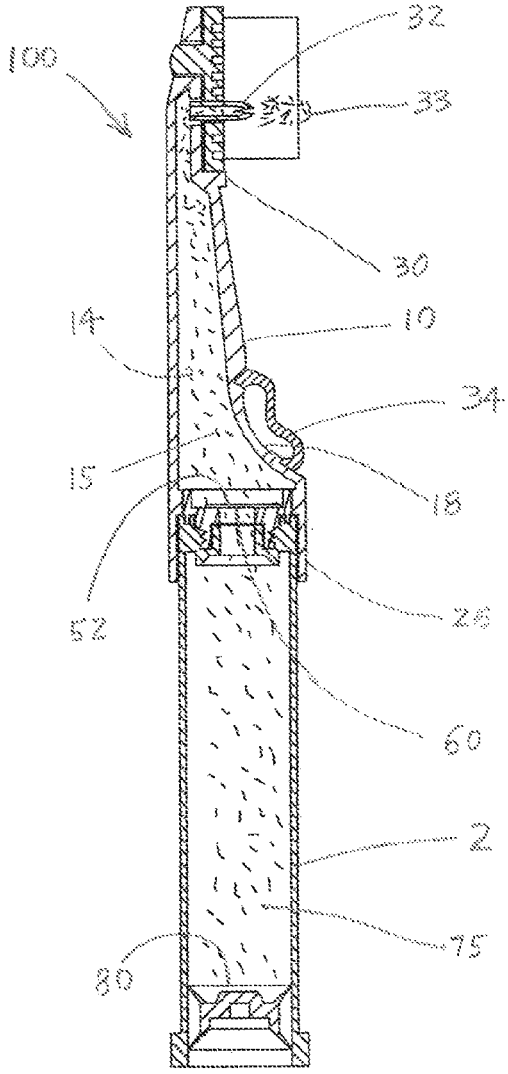
FIG. 2*b* is a front section view of the pump toothbrush of FIG. 2*a* with the check valve at the closed position and the slit spout opened when elastic button being depressed.

As shown in FIG. 1*a*, 1*b*, a pump toothbrush of this invention includes a pump head, a detachable bristle head and a refillable cartridge. FIG. la shows un-assembled pump toothbrush 100 with cartridge 2 and bristle head 4 being detached from pump head 6. Pump head 6 comprises side wall 10, pumping chamber 14 having opening 18 attached with actuator 22, inlet connector 26 and dispensing platform 30 which has flow channel 21 attached with spout 32. Both inlet connector 26 and dispensing platform 30 are supported by sidewall 10. FIG. 1*b* shows assembled pump toothbrush 100 having cartridge 2 attached to inlet connector 26 and bristle head 4 attached to dispensing platform 30. Pump chamber 14 having opening 18 attached with actuator 22 is in flow communication with inlet connector 26 and dispensing platform 30. When actuator 22 is depressed, a pumping force is applied to the dentifrice material (not shown) inside pump chamber 14 causing the dentifrice material to exit from dispensing platform 30. When the actuator is released from the depressed position, a vacuum force is created causing the dentifrice material (not shown) in the cartridge to flow into the pump chamber. In a preferred embodiment as shown in FIG. 2*a* and FIG. 2*b*, an actuator of pump toothbrush 100 is a dome-shaped resilient elastic compressible button 34. Resilient elastic compressible button 34 is attached to opening 18 on rigid sidewall 10 between inlet connector 26 and dispensing platform 30. One-way check valve 52 is mounted on valve-seat 56, which is attached to inlet connector 26. Valve-seat 56 has inlet opening 60 in flow communication between pumping chamber 14 and cartridge 2. Check valve 52 is pressed to close when a pumping force is applied to force dentifrice material in the pumping chamber 14 to exit from dispensing platform 30. The check valve is induced to open when the pumping force is released to allow the dentifrice material from the cartridge to flow into the pumping chamber. In a preferred embodiment the check valve uses flap 52 that overlaps the inlet opening 60 in valve-seat 56. Flap 52 is oriented to open toward dispensing platform 30 and to close toward cartridge 2. Valve-seat 56 has external threads 58 (shown in FIG. 1*a*) for engaging with the internal threads 74 (shown in FIG. 1*a*) on top-opening wall 76 (FIG. 1*a*) of the cartridge to fasten the cartridge to the pump head. When compressible elastic button 34 is released from a depressed position the dentifrice material, under the elastic button and elsewhere in the pump chamber and in the cartridge reservoir 75, all move with elastic button 34 such that a vacuum force is created causing piston 80 inside cartridge 2 to advance keeping the dentifrice material in a packed condition.

Dispensing Platform

Figure 3A:
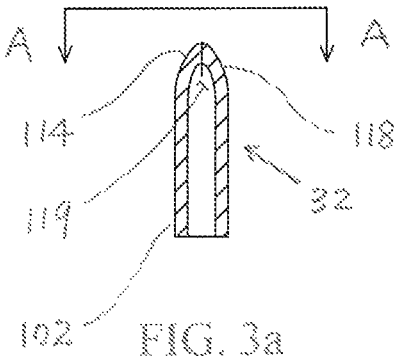
FIG. 3*a* is a cross-section view of a slit spout.
Figure 3B:
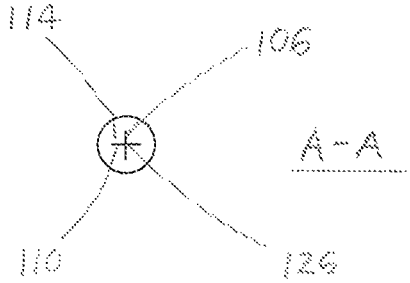
FIG. 3*b* is a top view of the slit spout of FIG. 3*a*.
Figure 3C:
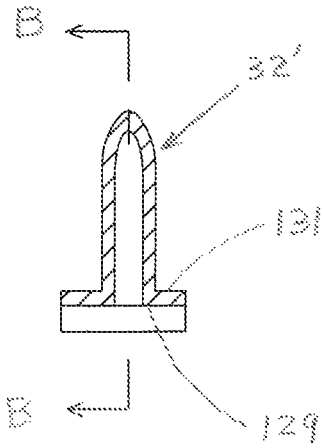
FIG. 3*c* is a front cross-section view of a slit spout having a snap-on flange at its base.
Figure 3D:
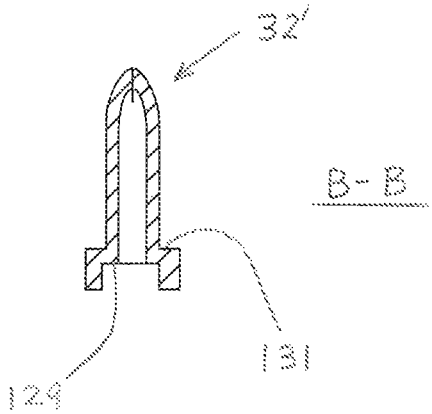
FIG. 3*d* a side cross-section view of the slit spout of FIG. 3*c*.
Figure 3E:
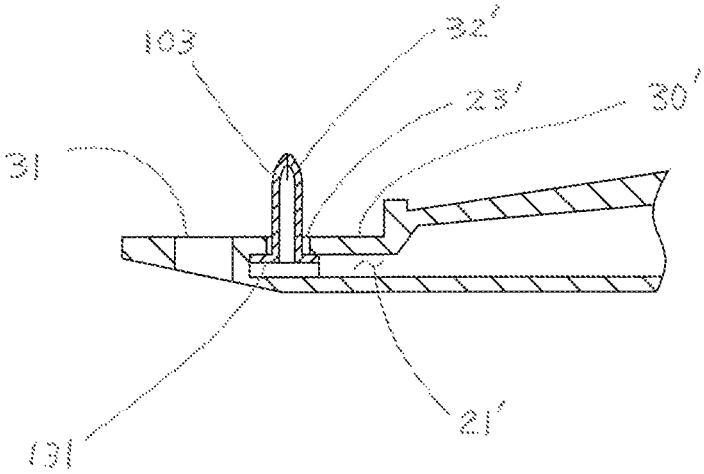
FIG. 3*e* shows the engagement of the slit spout of FIG. 3*c* in the flow channel of a dispensing platform.

The present invention uses a reusable spout to dispense dentifrice material to a disposable bristle head. The reusable spout is attached to a dispensing platform that is an extended portion of the pump head, The pump head is not to be thrown away with each disposal of disposable bristle head. FIG. 1*b* shows dispensing platform 30 having flow channel 21 and outlet opening 23. Spout 32 is mounted at the outlet opening 23. In a preferred embodiment the reusable spot is of slit configuration. As illustrated in FIG. 3*a* and FIG. 3*b*, self-sealing spout 32 has a tubular wall 102 with cross-slits 106 and 110. A slit spout is preferably made of thermoplastic elastomer material for resiliency by dip or injection molding and the cross slits are formed by slicing action of a sharp blade. A slit-spout has multiple flappers 114 (also shown in FIG. 2*b*) forming a normally closed dome-shaped surface 118 when the cavity is empty or not under pressure. Each flapper is a curved triangular valve segment extending from tubular wall 102 with tip of each valve segment intercepting at the center of the slit valve opening when the slit spout is closed. Each flapper segment can be bent outward like a cantilever beam such that slit-spout 32 is at open state as shown in FIG. 2*b*. The slit-spout is forced to open by exiting dentifrice material under the pumping pressure when the elastic compressible button is depressed. The slit spout closes after the elastic button is released. The slit length, wall thickness and the elastic modulus of the spout material are designed to ensure closing of the slit spout by the resiliency and the vacuum force when the pumping force is released. In manufacturing, a slit spout may be attached to the outlet opening wall 23 (shown in FIG. 1*b*) by adhesive bonding. Alternatively, as shown in FIG. 3*c* and FIG. 3*d* a slit spout may have a flange configuration with flange 131 attached to the base of the slit spout. The slit spout is inserted into the flow channel 21' by snapping through outlet opening 23'. FIG. 3*e* shows that the slit spout 32' is mounted with the flange 131 positioned inside flow channel 21' and the spout wall 103 extending from the top surface of the dispensing platform 30'. For supporting bristle head 4, dispensing platform 30' has through hole 31 for inserting pushbutton 5 (shown in FIG. 1*a* and FIG. 1*b*) of bristle head 4 for preventing the bristle head from lateral movements during brushing and for the ease of detaching the bristle head.

Disposable Bristle Head

Figure 4A:
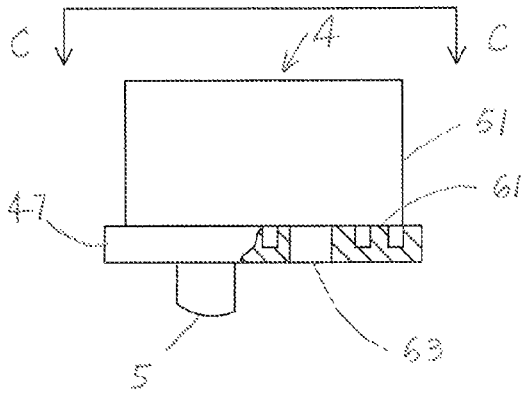
FIG. 4*a* is a front partial section view of a bristle head.
Figure 4B:
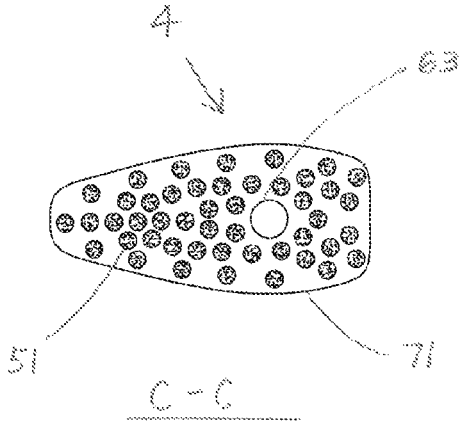
FIG. 4*b* is a top view of the bristle head of FIG. 4*a*.
Figure 5:
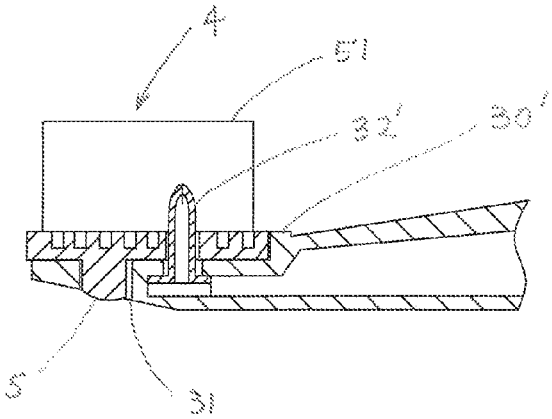
FIG. 5 is a front cross-section view of the engagement between a bristle head and a dispensing platform.

The through hole in the dispensing platform is a locating slot for mounting the bristle head. Referring to FIG. 4*a* and FIG. 4*b* bristle head 4 has base 47 having its frontside 61 attached with bristles 51 and its backside 55 attached with pushbutton 5, as well as having through opening 63 for inserting the slit spout of the dispensing platform 30. When bristle head 4 is mounted on the dispensing platform 30' as shown in FIG. 5, through opening 63 is inserted with the slit spout 32', and pushbutton 5 is inserted through the locating slot 31. Preferably sidewalls (not shown) on the periphery of dispensing platform 30 are shaped to fit the side surfaces 71 of the bristle head for lateral support. Additionally, the frontside of the bristle head may have flange portion (not shown) for covering the top of the sidewalls of the dispensing platform. The bristle head can be detached by pressing the pushbutton off the dispensing platform.

Cartridge

Figure 6A:
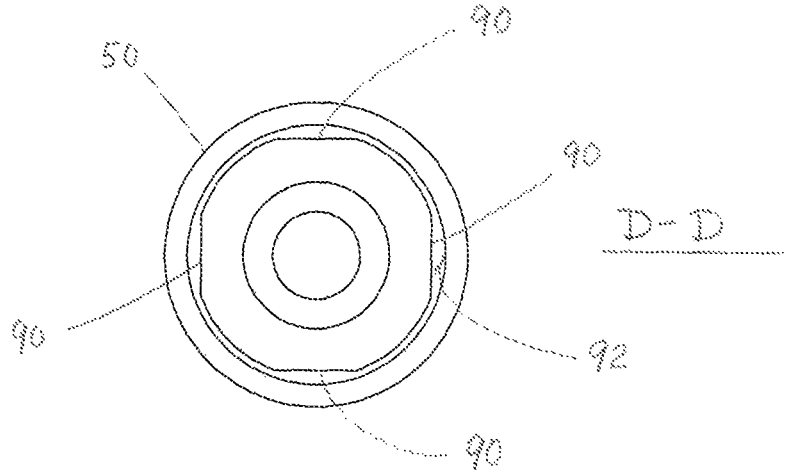
FIG. 6*a* is a top view of a piston and cartridge engagement showing vent clearances.
Figure 6B:
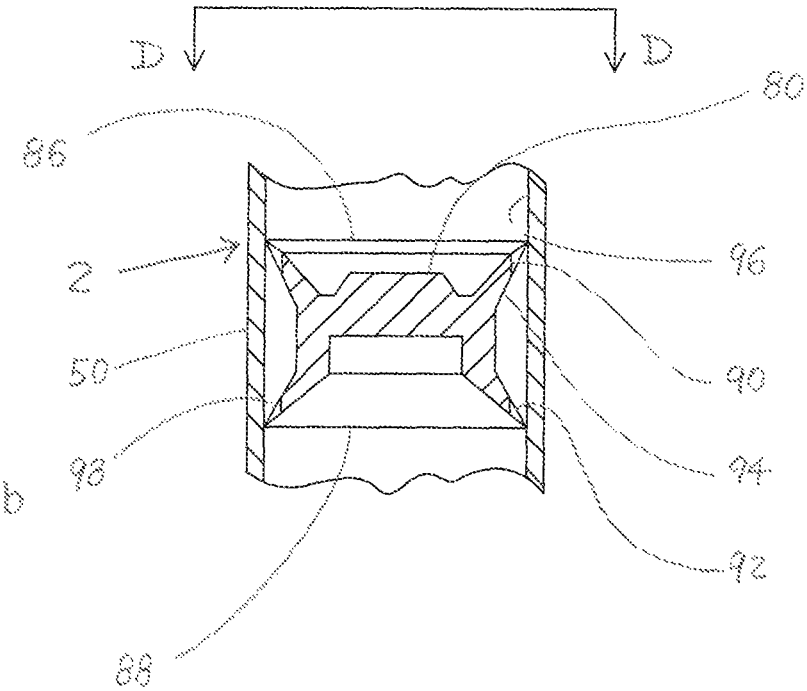
FIG. 6*b* is a front section view showing vent clearances between piston rims and the cartridge wall.

Referring to FIG. 1*a*, cartridge 2 includes cylindrical tube 50 and piston 80. Cylindrical tube 50 has interior threads 74 on annular wall extension at top opening end 76. Piston 80 has upper annular rim 86 and lower annular rim 88. Piston 80 is inserted into cylindrical tube 50 through bottom opening end 54 of cartridge 2 to provide slidable sealing of the dentifrice material. The engagement between piston 80 and cartridge 2 is further shown in FIG. 6*a* and FIG. 6*b*. In one embodiment, piston 80 has vent segments 90 on its upper rim 86 and lower rim 88 of its flexible annular walls 94 and 98. In a preferred embodiment, a vent segment is a flat area 90 on a curved rim. The vent segments form vent clearances 92 when the piston is inserted in contact with cartridge inner wall surface 96.

Although the upper and lower rims are in sealing contact with the cartridge wall, the flat vent-segments 90 do not contact the cartridge wall surface 96. Vent clearances 92 between the flat vent-segments 90 and the cartridge wall 96 are sufficiently small such that no dentifrice material can seep through except the air.

Refilling Steps

Figure 7A:
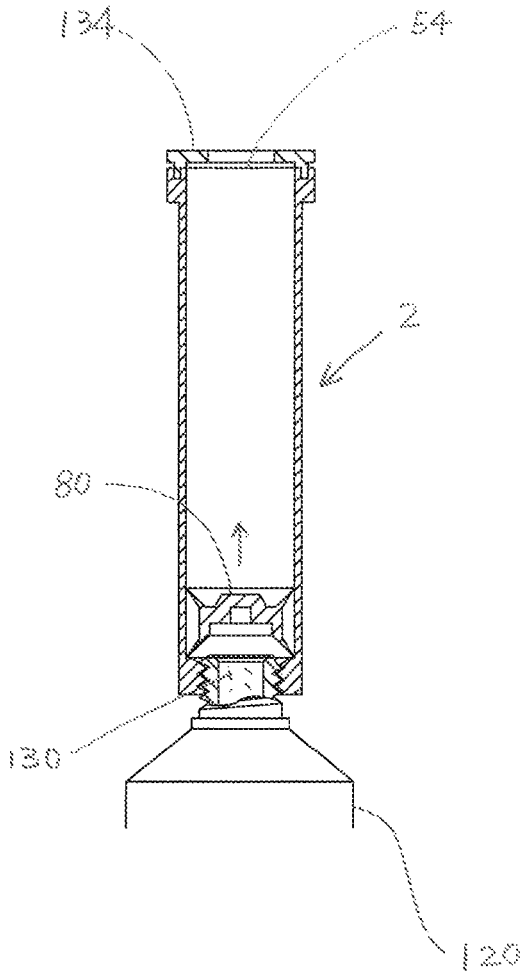
FIG. 7*a* shows the engagement of a cartridge with a toothpaste tube prior to filling.
Figure 7B:
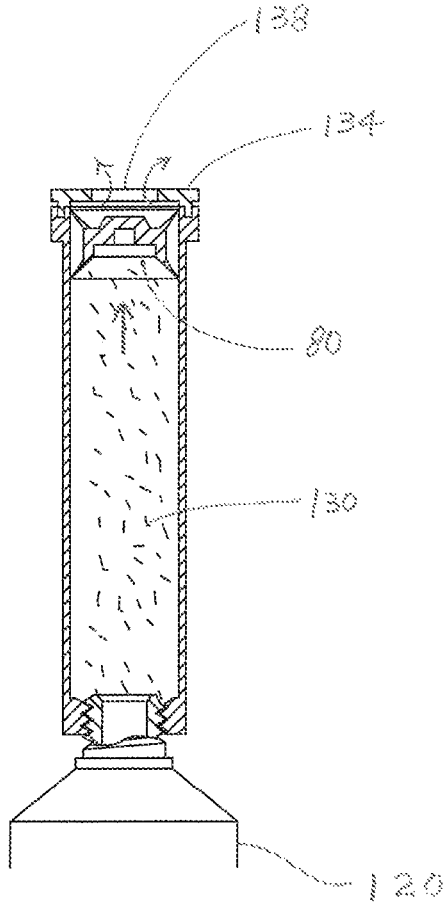
FIG. 7*b* shows filling of the cartridge with the piston pushed to the bottom end of the cartridge.

A cartridge of the present invention can be refilled from a bulk toothpaste tube. It requires the outlet of a bulk toothpaste tube having a fastening means for attaching a cartridge. Prior to attaching a cartridge for filling, the content of the bulk toothpaste tube needs to be pushed to the outlet opening of the bulk toothpaste tube to expel air if any. Separately, the piston in a cartridge needs to be moved to the foremost position in the cartridge. In such manner the interface space between the bulk toothpaste tube and the cartridge is nearly free of voids when the two are engaged for filling. FIG. 7*a* shows the engagement of cartridge 2 and bulk toothpaste tube 120. After the engagement, the dentifrice material in the bulk toothpaste tube 120 is pumped into cartridge 2. The incoming flow forces piston 80 to move toward the bottom opening end 54 of the cartridge. Dentifrice material 130 from the bulk toothpaste tube cannot leak through piston 80 due to sliding fit between annular rims and the cartridge wall. Any entrapped air bubbles can escape through the vent clearances between the flat segments of the piston and the cartridge wall. The piston is blocked by end cap 134, which is placed at the bottom end of the cartridge as shown in FIG. 7*b*. The end cap has opening 138 at the center for exposing the piston to the ambient pressure. Furthermore, end cap 134 is detachable to allow removal of piston 80 for cleaning any residual dentifrice material after repeated uses.

A filled cartridge is fastened to the inlet connector by threading the cartridge onto the threaded valve-seat of the pump chamber. To prime an empty pump toothbrush, one needs to push the piston in the cartridge forward to force the dentifrice material to flow through the one-way check valve into pump chamber and to the slit spout. It is preferable to hold down the elastic button to avoid air entrapment in the cavity of the elastic button during the priming step. This priming step prepares the pump toothbrush to be ready for use. Once the flow path of the pump toothbrush is fully filled, the dentifrice material is pumped out from the spout by pressing down the compressible button as described previously.

Gum Guards

Figure 8A:
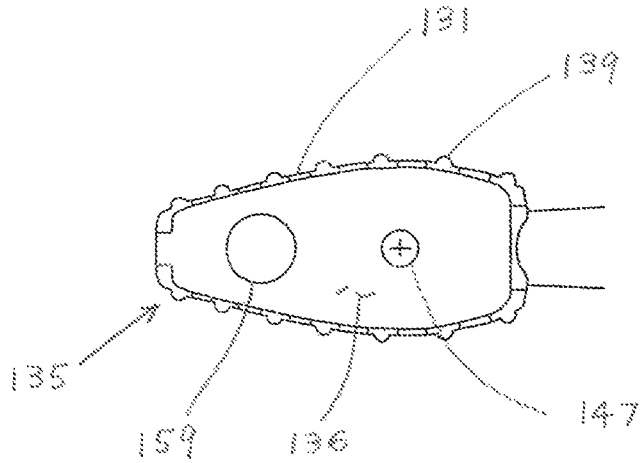
FIG. 8*a* is a top view of a dispensing platform having molded-in gum guard elements.
Figure 8B:
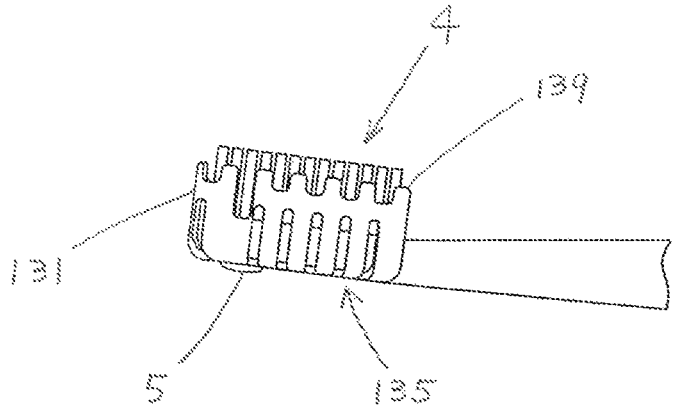
FIG. 8*b* is a front view of a bristle head attached to a dispensing platform having molded-in gum guard elements.
Figure 8C:
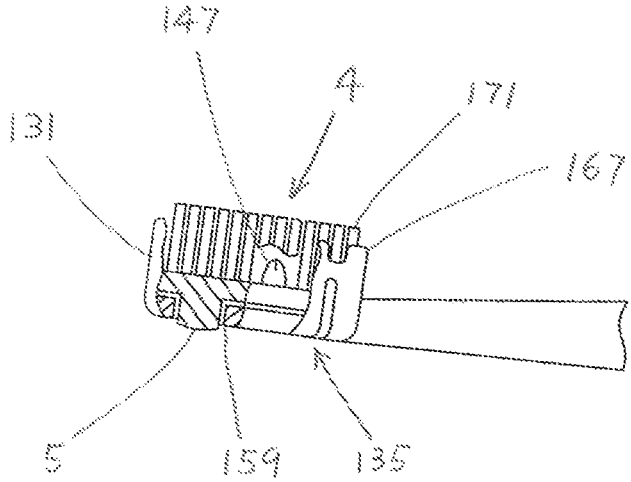
FIG. 8*c* is a partial front cross-section view of the engagement of the bristle head on the dispensing platform of FIG. 8*b*.

Optionally sidewalls of the dispensing platform are attached with rubber gum-guard elements. The gum-guard elements can be used as a guide feature for providing feedback to a user regarding proper brushing pressures and angles during brushing. The features of gum-guard elements have been described in U.S. Pat. No. 6,599,048 by Kuo, in which the gum-guard elements are attached to brush head. In the present invention, the gum-guard elements are attached to the dispensing platform. Referring to FIG. 8*a* the rubber gum-guard elements 139 are formed as sidewalls 131 along the periphery of dispensing platform 135, whose center portion is for mounting a bristle head. FIG. 8*a* and FIG. 8*b* show the attachment of bristle head 4 on the dispensing platform 135. With bristle head 4 (configuration shown in FIG. 4*a* and FIG. 4*b*) mounted on platform 135, slit spout 147 is extended from through-hole 63 and locating slot 159 is inserted with pushbutton 5 of the bristle head. For the convenience of dislodging the bristle head, pushbutton 5 is accessible from bottom side 163 of the dispensing platform 135. Furthermore, top 167 of the gum-guard elements are at a level lower than top 171 of bristles for limiting the deflection and the pressure on the bristles. The distance of the rubber guard from opposing outer bristle tufts can limit the brushing angle against the gumlines between teeth and gum tissues. The difference of heights between the rubber guard and the outer bristles is based on the stiffness of bristles and desired maximum brushing pressure. The Durometer or hardness of the rubber wall material can be selected for providing distinct feel to serve as a feedback signal when the limit of brushing pressure or angle is reached. Additionally, the rubber guard can be used for massaging gum tissues by stroking and sliding the outer surfaces of the rubber guard against the gum tissues.

The invention has been described in detail with reference to a preferred embodiment and application thereof. However, it is understood that variations, modifications and applications can be effected within the spirit and scope of the present invention. Applications may include dispensing cleaning agents, cosmetic creams, adhesive materials, colorants, medications and drugs, as well as attachment with applicators for applying the content of the pump toothbrush of the present invention

I claim:

1. A pump toothbrush comprising: i. a pump head including; a. a sidewall, b. a pumping chamber having an opening attached with an actuator, c. a dispensing platform extending from the sidewall, said dispensing platform having a flow channel with an outlet opening attached with a slit spout; d. an inlet connector supported by said sidewall having a valve seat with an inlet opening there through, said valve seat being attached with a check valve overlapping the inlet opening which is in flow communication with the flow channel of said dispensing platform; ii. a cartridge containing dentifrice material attached to said inlet connector, said cartridge having a cylindrical tube and a piston, iii. a replaceable bristle head having a base attached with bristles and a pushbutton for detaching said bristle head, said base having an opening for inserting with said slit spout to receive the dentifrice material from said slit spout, and said bristle head being detachable from said dispensing platform while the dentifrice material being enclosed inside said slit spout.

2. The pump toothbrush of claim 1 wherein said slit spout opens to dispense dentifrice material when the actuator is pressed to a depressed position and said slit spout returns to its originally closed position when the actuator is released from the depressed position.

3. The pump toothbrush of claim 1 wherein said actuator being elastic compressible button that returns to its original shape when released from a depressed position.

4. The pump toothbrush of claim 1 wherein said slit spout is of slit configuration made of elastomer material and has multiple flappers forming a normally closed dome-shaped surface when no pumping force is applied.

5. The pump toothbrush of claim 1 wherein said cartridge is detachable from said pump head.

6. The pump toothbrush of claim 1 wherein said cartridge being attached to said valve-seat by threads.

* * * * *